US007513106B2

(12) United States Patent
Owens

(10) Patent No.: US 7,513,106 B2
(45) Date of Patent: Apr. 7, 2009

(54) METHOD FOR HYDROCARBON INJECTION INTO AN EXHAUST SYSTEM, UPSTREAM OF A TURBOCHARGER, WHILE MINIMIZING EXPOSURE OF THE EXHAUST GAS RECIRCULATION SYSTEM TO THE SAME HYDROCARBONS

(75) Inventor: Douglas E Owens, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 11/591,064

(22) Filed: Nov. 1, 2006

(65) Prior Publication Data

US 2008/0098730 A1 May 1, 2008

(51) Int. Cl.
*F01N 3/20* (2006.01)
*F02B 17/00* (2006.01)

(52) U.S. Cl. ..... 60/278; 60/285; 60/286; 123/299

(58) Field of Classification Search ..... 123/434–438, 123/27 R, 299, 568.11; 60/274, 276, 278, 60/288, 323, 285, 286, 303; 73/118.1
See application file for complete search history.

(56) References Cited

U.S. PATENT DOCUMENTS 3,941,104 A 3/1976 Egli
4,381,643 A 5/1983 Stark
4,509,483 A * 4/1985 Johnson ..... 123/672
4,556,032 A * 12/1985 Miller ..... 123/438
5,956,947 A * 9/1999 Tanaka et al. ..... 60/297
6,009,742 A * 1/2000 Balko ..... 73/23.31
6,164,063 A * 12/2000 Mendler ..... 60/274
6,233,927 B1 5/2001 Hirota et al.
6,389,804 B1 * 5/2002 Yasui et al. ..... 60/277
6,615,580 B1 9/2003 Khair et al.
6,742,335 B2 * 6/2004 Beck et al. ..... 60/605.2
6,792,749 B2 * 9/2004 Ueno et al. ..... 60/284
6,945,034 B2 * 9/2005 Ueno et al. ..... 60/288
7,159,386 B2 * 1/2007 Opris ..... 60/283
7,207,323 B1 * 4/2007 Hemsath ..... 123/568.11
2002/0113694 A1 8/2002 Muirhead
2003/0033800 A1 2/2003 Tonetti et al.
2006/0010859 A1 1/2006 Yan et al.
2006/0063046 A1 3/2006 Hu et al.

OTHER PUBLICATIONS

International Search Report and Written Opinion for PCT/US2007/83349, 10 pages.

* cited by examiner

*Primary Examiner*—Willis R. Wolfe, Jr.
*Assistant Examiner*—Johnny H. Hoang
(74) *Attorney, Agent, or Firm*—Baker & Daniels LLP

(57) ABSTRACT

The present invention generally relates to engines, and, more particularly, to an exhaust system for reducing buildup in an exhaust gas recirculation system when mixing hydrocarbons with exhaust.

33 Claims, 4 Drawing Sheets

METHOD FOR HYDROCARBON INJECTION INTO AN EXHAUST SYSTEM, UPSTREAM OF A TURBOCHARGER, WHILE MINIMIZING EXPOSURE OF THE EXHAUST GAS RECIRCULATION SYSTEM TO THE SAME HYDROCARBONS

TECHNICAL BACKGROUND OF THE INVENTION

The present invention relates to engines, and, more particularly, to an engine for reducing buildup in an exhaust gas recirculation system when mixing hydrocarbons with exhaust.

BACKGROUND OF THE INVENTION

Generally an exhaust system routes exhaust gas out of the engine. Typically, diesel engines require hydrocarbon injection into the exhaust system to reduce buildup in aftertreatment systems. One way of injecting hydrocarbons into the exhaust system is by utilizing the engine's fuel injection system, which is capable of in-cylinder dosing.

SUMMARY OF THE INVENTION

One embodiment of the present invention is an engine for reducing buildup in an exhaust gas recirculation system when mixing hydrocarbons with exhaust, the engine including an exhaust system including a first conduit and a second conduit separated from the first conduit, a hydrocarbon injection system configured to provide hydrocarbons to the first conduit, and an exhaust gas recirculation tube operably coupled to the second conduit.

Another embodiment of the present invention is a method for reducing buildup in an exhaust gas recirculation system when mixing hydrocarbons with exhaust, the method including the steps of providing hydrocarbons to a first conduit to cause active regeneration, recirculating at least a portion of the exhaust from a second conduit, and substantially impeding the hydrocarbons from entering the second conduit.

A further embodiment of the present invention is an engine for reducing buildup in an exhaust gas recirculation system when mixing hydrocarbons with exhaust, the engine including means for providing hydrocarbons to a first conduit to cause active regeneration, means for recirculating at least a portion of a second conduit, and means for substantially impeding the hydrocarbons from entering the second conduit.

Yet another embodiment of the present invention is an engine for reducing buildup in an exhaust gas recirculation system when mixing hydrocarbons with exhaust, the engine including an exhaust system including a first exhaust channel in fluid communication with a first exhaust passageway and a second exhaust channel in fluid communication with a second exhaust passageway, the first exhaust passageway separated from the second exhaust passageway, a hydrocarbon injection system adapted to provide hydrocarbons to the first exhaust channel, and an exhaust gas recirculation tube adapted to operably couple to the second exhaust passageway.

Still another embodiment of the present invention is an engine for reducing buildup in an exhaust gas recirculation system when mixing hydrocarbons with exhaust, the engine including an exhaust system including a first exhaust channel and a second exhaust channel, a hydrocarbon injection system to provide hydrocarbons to the first exhaust channel, an exhaust gas recirculation tube configured to couple to the second exhaust channel and a barrier to separate the first exhaust channel and the second exhaust channel.

Yet a further embodiment of the present invention is an exhaust system for reducing buildup in an exhaust gas recirculation system when mixing hydrocarbons with exhaust, the exhaust system including a first exhaust channel configured to couple to a first cylinder, the first exhaust channel configured to receive non-recirculating exhaust gas and hydrocarbons, the first exhaust channel separated from recirculating exhaust gas.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
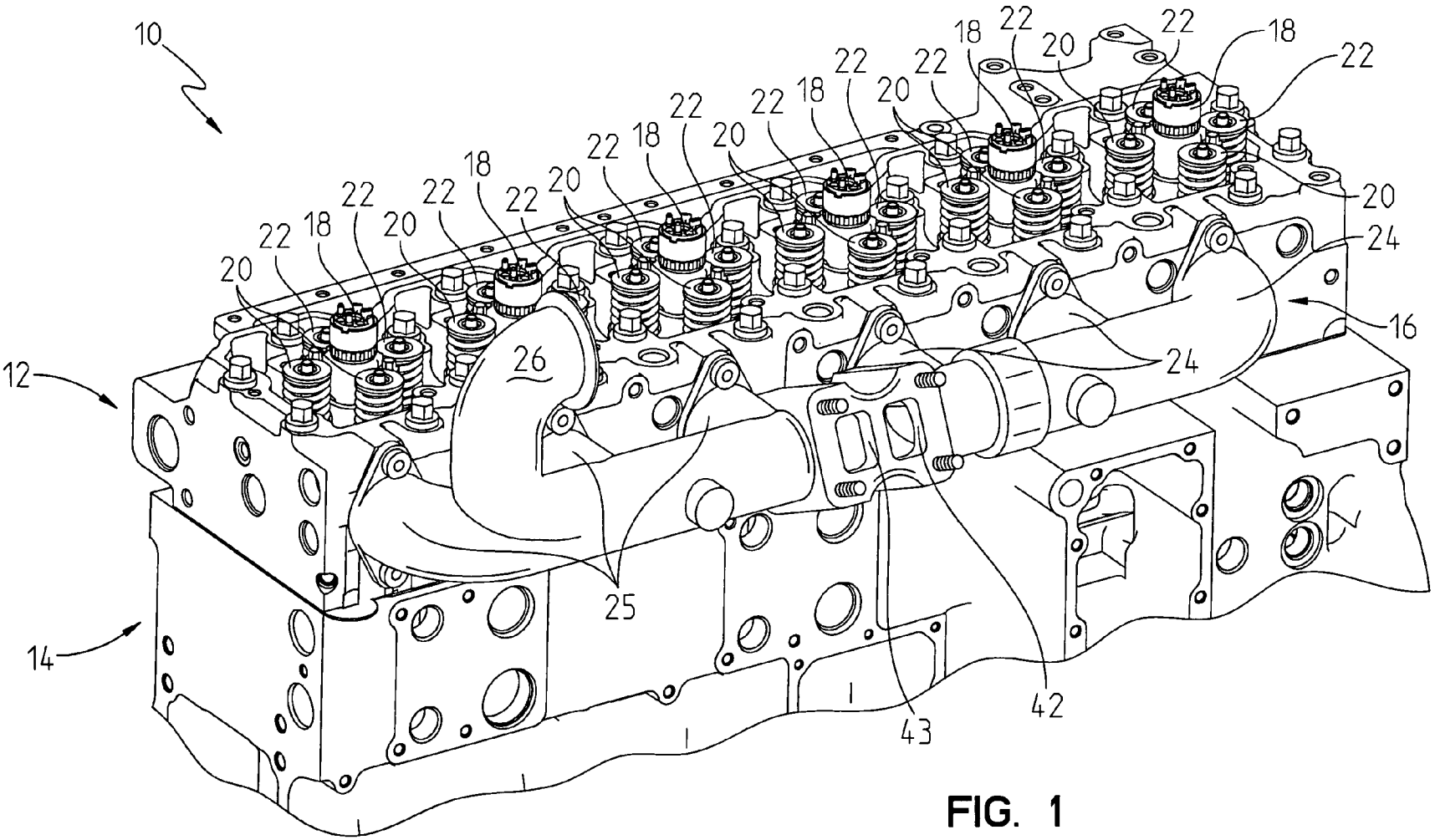
FIG. 1 is a perspective view of one embodiment of an engine of the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

Unless specifically limited otherwise, the terms "fuel" and "hydrocarbon" are used interchangeably and have the same meaning for this disclosure. For example, terms such as "fuel-included exhaust" may be interpreted to mean "hydrocarbon-included exhaust." "Recirculating exhaust," as used herein, includes situations wherein at least a portion of the exhaust may recirculate through an exhaust gas recirculation tube or some similar exhaust subsystem. "Non-recirculating exhaust," as used herein, includes situations wherein exhaust is substantially limited, impeded or prevented from recirculation through an exhaust gas recirculation tube or some similar exhaust subsystem. "In-cylinder dosing" is where fuel is injected into exhaust gas during the exhaust stroke. In-cylinder dosing is one process to achieve "active regeneration" which is the process of injecting fuel into exhaust gas to aid in catalytic conversion of soot.

The embodiments disclosed below are not intended to be exhaustive or limit the invention to the precise forms disclosed in the following detailed description. Rather, the embodiments are chosen and described so that others skilled in the art may utilize their teachings.

Referring now to FIG. 1 and a first embodiment, an engine 10 including injector block 12, cylinder block 14, and exhaust system 16 is shown. As shown in FIG. 1, cylinder block 14 supports injector block 12 while exhaust system 16 is coupled to injector block 12. Injector block 12 supports fuel injection systems 18, exhaust valves 20 and intake valves 22. Exhaust system 16 includes first channels 24, second channels 25 and an exhaust gas recirculation tube 26.

Figure 2:
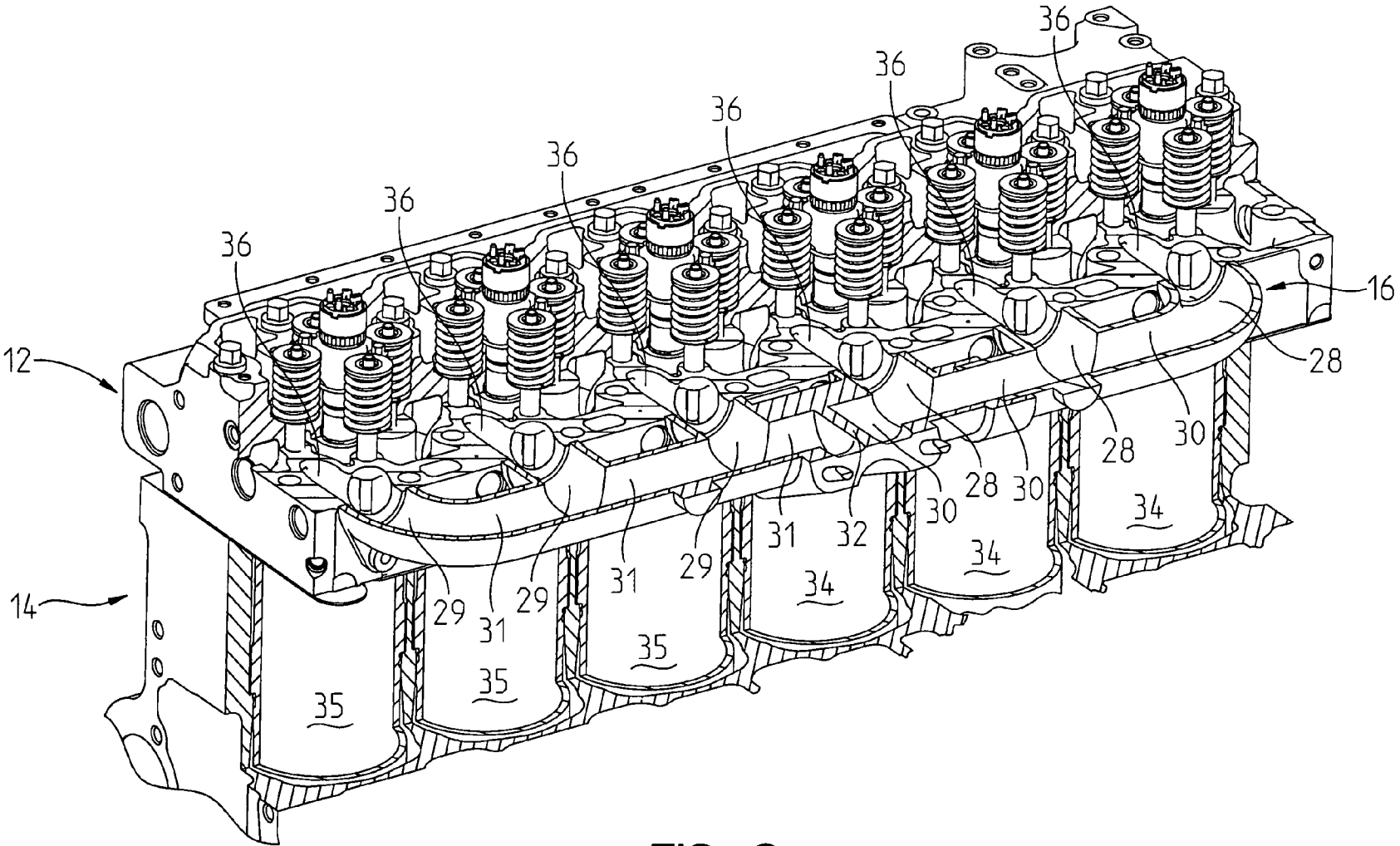
FIG. 2 is a partial perspective view of a portion of the engine shown in of FIG. 1.
Figure 3:
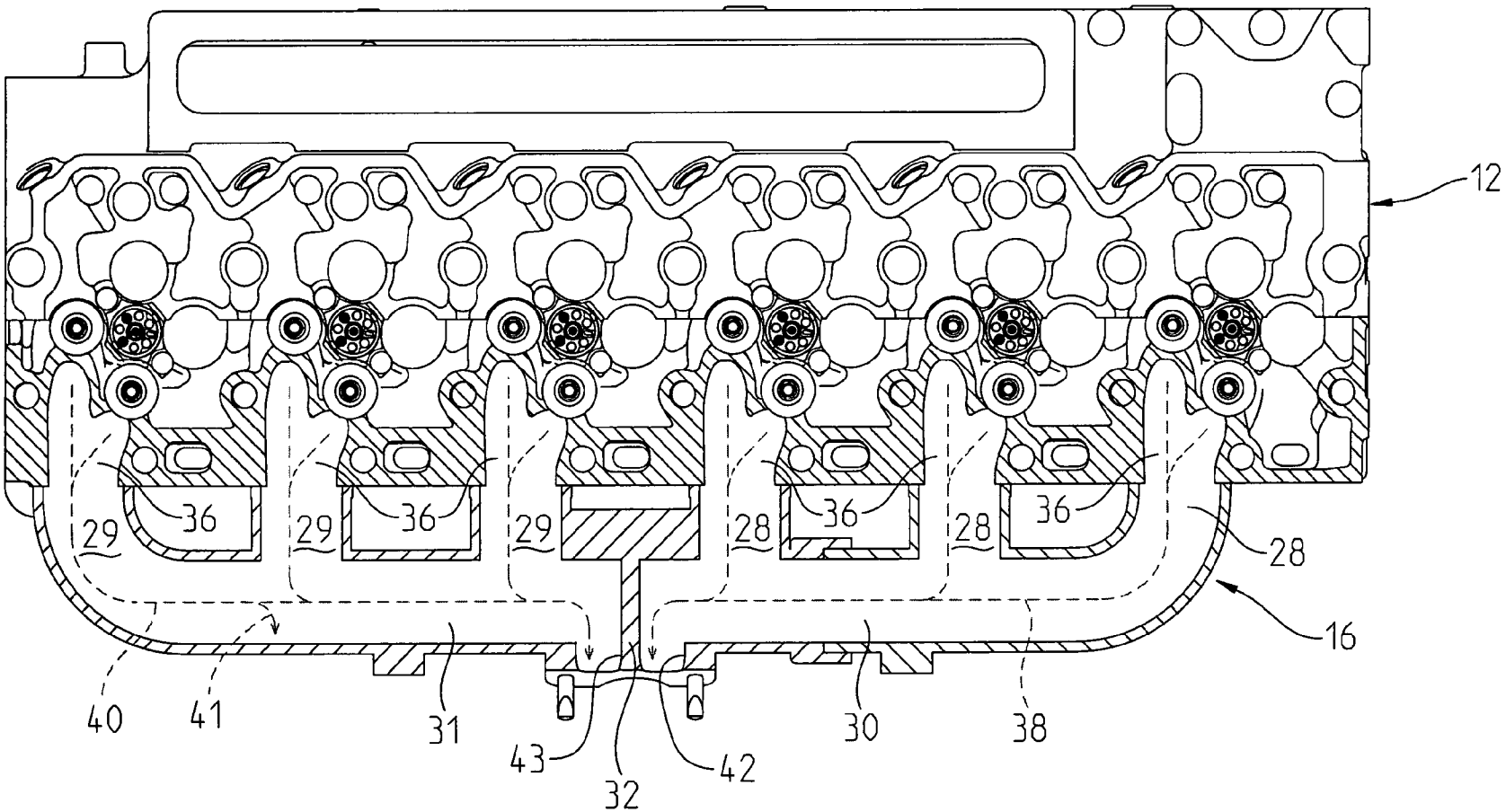
FIG. 3 is a partial, cross sectional view, of a portion of an injector block and exhaust system of the engine shown in the previous figures.

Referring to FIG. 2, exhaust system 16 defines first conduits 28, second conduits 29, first passageway 30, second passageway 31 and barrier 32. First conduits 28 are in communication with first passageway 30. Second conduits 29 are in communication with second passageway 31. Exhaust gas recirculation tube 26 (FIG. 1) is also in communication with second passageway 31. Barrier 32 separates first passageway 30 and second passageway 31. Cylinder block 14 defines first cylinders 34 and second cylinders 35. Fuel injection systems 18 are adapted to inject fuel into first cylinders 34, as discussed in more detail below. Injector block 12 defines ducts 36. Ducts 36 are adapted to communicate with first cylinders 34 and second cylinders 35 dependent upon whether exhaust valves 20 are open or closed. As illustrated in FIG. 3, ducts 36 are also in communication with first conduits 28 and second conduits 29.

As illustrated by FIG. 2, barrier 32 is integral with the rest of exhaust system 16. Also barrier 32 is illustrated as located with three first channels 24 and three first conduits 28 on one side of barrier 32 and three second channels 25 and three second conduits 29 on another side of barrier 32. Within the scope of this disclosure, barrier 32 may be located anywhere on exhaust system 16 such that first passageway 30 is on one side of barrier 32 while second passageway 31 is on another side of barrier 32. Also within the scope of this disclosure, exhaust system 16 is not limited to a specific number of channels or conduits.

In operation of engine 10, each fuel injection system 18 is capable of in-cylinder dosing, independent of the other fuel injection systems 18. Fuel injection systems 18 dose first cylinders 34 with fuel during the exhaust stroke. When exhaust valves 20 open, exhaust along with fuel is forced out of first cylinders 34 and through ducts 36. As illustrated in FIG. 3, this fuel-included exhaust gas follows along arrow 38, through first conduits 28 and first passageway 30 and exits exhaust system 16 at opening 42. Fuel injection systems 18 do not dose second cylinders 35 during the exhaust stroke. Exhaust gas from second cylinders 35 exhaust does not substantially include fuel, but is substantially all exhaust gas. As also illustrated in FIG. 3, during the exhaust stroke this all-exhaust gas is forced out of second cylinders 35, and along arrow 40, through ducts 36, second conduits 29 and second passageway 31. At least a portion of the all-exhaust gas may recirculate through exhaust gas recirculation tube 26, as illustrated by arrow 41 in FIG. 3. At least a portion of the all-exhaust gas may reenter first and second cylinders 34, 35 through intake valves 22. Another portion of the all-exhaust gas may exit exhaust system 10 at opening 43.

As previously mentioned, barrier 32 separates first passageway 30 and second passageway 31. Barrier 32 limits, impedes and substantially prevents exposure of fuel-included exhaust gas to exhaust gas recirculation tube 26.

Figure 4:
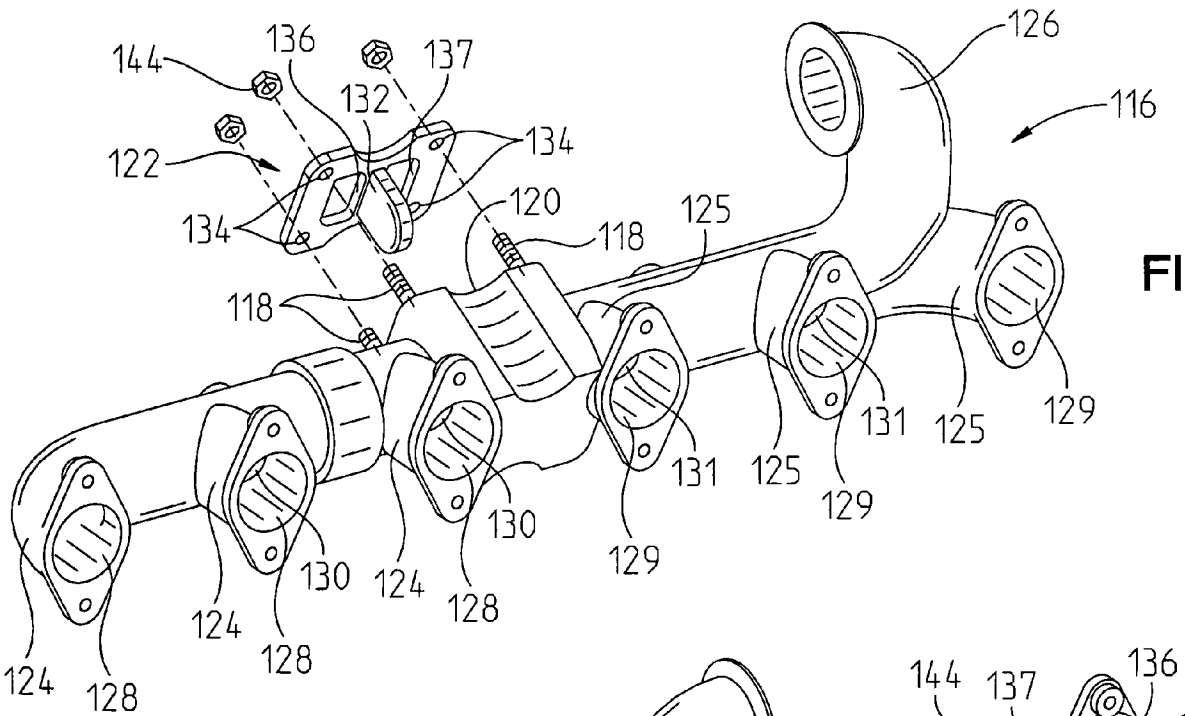
FIG. 4 is an exploded view of another embodiment of the exhaust system shown in FIG. 1 with an insert including a barrier shown in an exploded position.
Figure 5:
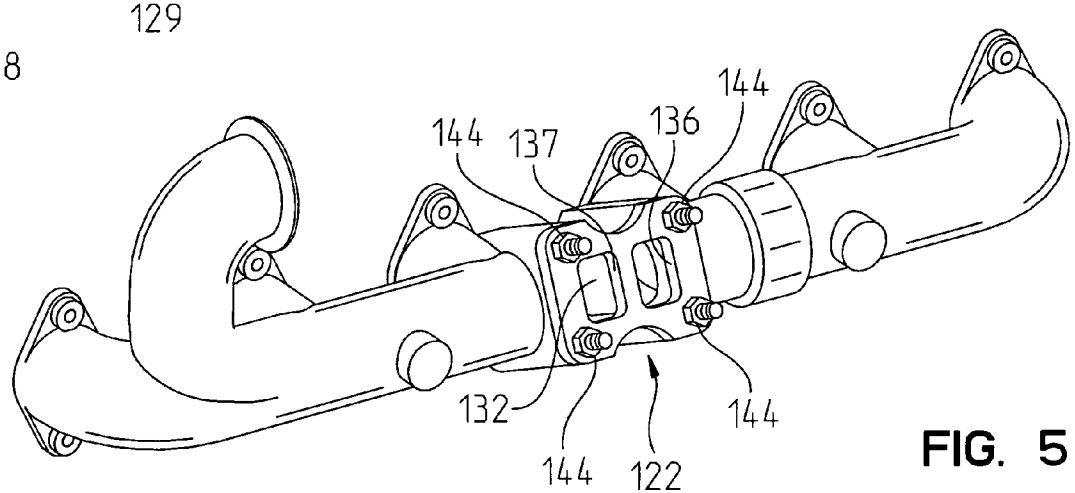
FIG. 5 is a perspective view of the exhaust system shown in FIG. 4.

In a second embodiment, as illustrated in FIG. 4, insert 122 may be non-integral with the rest of exhaust system 116. Exhaust system 116 defines first conduits 128, second conduits 129, first passageway 130, second passageway 131 and exhaust gas recirculation tube 126. Exhaust system 116 also defines aperture 120 (labeled, but not shown). Exhaust system 116 includes posts 118 or other coupling means such as clamps, hooks, latches, bolts or rivets. First conduits 128 are in communication with first passageway 130. Second conduits 129 are in communication with second passageway 131. Exhaust gas recirculation tube 126 is also in communication with second passageway 131. Insert 122 includes barrier 132 and defines apertures 134 or includes other coupling means such as clamps, hooks, latches or rivets. For example, insert 122 couples to exhaust system 116 by use of nuts 144. As illustrated in FIG. 5, when insert 122 is coupled to exhaust system 116, barrier 132 is at least partially disposed within aperture 120. Aperture 120 is in communication with first and second passageways. Insert 122 defines first opening 136 and second opening 137. First opening 136 is configured to communicate with a first passageway similar into the exhaust system of the first embodiment; second opening 137 is configured to communicate with a second passageway similar into the exhaust system of the first embodiment.

As illustrated by FIG. 4, barrier 132 is illustrated as located with three first channels 124 and three first conduits 128 on one side of barrier 132 and three second channels 125 and three second conduits 129 on another side of barrier 132. Within the scope of this disclosure, barrier 132 may be located anywhere on exhaust system 116 such that first passageway 130 is on one side of barrier 132 while second passageway 131 is on another side of barrier 32. Also within the scope of this disclosure, exhaust system 116 is not limited to a specific number of channels or conduits. When insert 122 is coupled to the rest of exhaust system 116 (FIG. 5), the operation of the second embodiment is the same in operation of the first embodiment previously described.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An engine for reducing buildup in an exhaust gas recirculation system when mixing hydrocarbons with exhaust comprising:

an exhaust system including:

a first engine cylinder in communication with a first injection system, the first injection system configured to inject hydrocarbons into the first engine cylinder;

a first exhaust passage in communication with the first engine cylinder;

the first injection system configured to provide hydrocarbons to the first exhaust passage when the first engine cylinder moves a first exhaust gas into the first exhaust passage;

a second engine cylinder in communication with a second injection system, the second injection system configured to inject hydrocarbons into the second engine cylinder;

a second exhaust passage in communication with the second engine cylinder;

the second injection system inoperative when the second engine cylinder moves a second exhaust gas into the second exhaust passage;

wherein the first exhaust passage and the second exhaust passage are separated from each other to inhibit entry of the first exhaust gas into the second exhaust passage.

2. The engine of claim 1 wherein the engine is a diesel engine.

3. The engine of claim 1 wherein the first injection system is a direct fuel injection system.

4. The engine of claim 1 wherein the exhaust system is an exhaust manifold.

5. The engine of claim 4 wherein the engine includes a plurality of cylinders, the first exhaust passage being configured to receive exhaust from at least one of the plurality of cylinders.

6. The engine of claim 5 wherein the second exhaust passage is configured to prevent receipt of the exhaust from the at least one of the plurality of cylinders.

7. The engine of claim 1 wherein the exhaust system includes an exhaust gas recirculation tube, wherein the exhaust system provides for operation of the exhaust gas recirculation tube during active regeneration while limiting exposure to the hydrocarbons.

8. The engine of claim 1 wherein the first injection system is configured to perform in-cylinder dosing.

9. The engine of claim 8 wherein an exhaust gas recirculation tube is configured to recirculate exhaust during in-cylinder dosing.

10. The engine of claim 1 wherein the exhaust system includes an exhaust gas recirculation tube, wherein the exhaust system provides for operation of the exhaust gas recirculation tube during active regeneration while impeding exposure to the hydrocarbons.

11. The engine of claim 1 further comprising an exhaust gas recirculation tube operably coupled to the second exhaust passage.

12. The engine of claim 11, wherein the first exhaust passage and the second exhaust passage are separated to impede entry of the first exhaust gas into the exhaust gas recirculation tube.

13. The engine of claim 1 further comprising at least one third engine cylinder in communication with the first exhaust passage, and a third exhaust gas from the at least one third engine cylinder is substantially impeded from entering the second exhaust passage.

14. A method for reducing buildup in an exhaust gas recirculation system when mixing hydrocarbons with exhaust comprising the steps of:

providing a fuel injection system to provide hydrocarbons to a first cylinder during an exhaust cycle of the first cylinder such that the hydrocarbons enter a first exhaust passage, the fuel injection system inoperative to provide hydrocarbons to a second cylinder during the exhaust cycle of the second cylinder such that the hydrocarbons do not enter a second exhaust passage;

providing the hydrocarbons to the first exhaust passage to cause active regeneration;

recirculating at least a portion of exhaust from the second cylinder by way of the second exhaust passage, the second exhaust passage isolated from the first exhaust passage;

and substantially impeding the hydrocarbons from entering the second exhaust passage.

15. The method of claim 14 further comprising the step of:

providing the hydrocarbons to the first exhaust passage while recirculating at least a portion of exhaust from the second exhaust passage.

16. The method of claim 14 wherein the first exhaust passage and the second exhaust passage form a portion of an exhaust manifold.

17. The method of claim 14 wherein the step of providing hydrocarbons includes in-cylinder dosing.

18. The method of claim 14 wherein the recirculating step includes providing the at least a portion of exhaust to an exhaust gas recirculation tube.

19. The engine of claim 16, wherein the exhaust manifold further comprises a tube in communication with the second exhaust passage for recirculating the at least a portion of exhaust.

20. The engine of claim 19, wherein the first exhaust passage and the second exhaust passage share a common wall.

21. The engine of claim 20, wherein the tube is located closer to the second cylinder than to the common wall.

22. An engine for reducing buildup in an exhaust gas recirculation system when mixing hydrocarbons with exhaust comprising:

means for providing hydrocarbons to a first exhaust passage to cause active regeneration;

means for recirculating at least a portion of exhaust from a second exhaust passage isolated from the first exhaust passage; and means for substantially impeding the hydrocarbons from entering the second exhaust passage.

23. An engine for reducing buildup in an exhaust gas recirculation system when mixing hydrocarbons with exhaust comprising:

an exhaust system including a first exhaust channel in communication with a first exhaust passageway and a second exhaust channel in fluid communication with a second exhaust passageway, the first exhaust passageway isolated from the second exhaust passageway;

a first injection system adapted to provide hydrocarbons to a first engine cylinder and the first exhaust channel; and an exhaust gas recirculation tube coupled to the second exhaust passageway, wherein the first exhaust passageway is isolated from the second exhaust passageway between the first engine cylinder and the exhaust gas recirculation tube.

24. The engine of claim 23 wherein the hydrocarbons are at least substantially prevented from exposure to the second exhaust channel.

25. The engine of claim 23 wherein the first injection system is adapted to perform in-cylinder dosing.

26. The engine of claim 25 wherein the exhaust gas recirculation tube recirculates exhaust during in-cylinder dosing.

27. The engine of claim 23 wherein the exhaust system provides for operation of the exhaust gas recirculation tube during active regeneration without substantial exposure to the hydrocarbons.

28. An engine for reducing buildup in an exhaust gas recirculation system when mixing hydrocarbons with exhaust comprising:

an exhaust system including a first exhaust channel and a second exhaust channel;

a first injection system to provide hydrocarbons to a first engine cylinder and the first exhaust channel;

an exhaust gas recirculation tube coupled to the second exhaust channel; and a barrier isolating the first exhaust channel from the second exhaust channel between the first engine cylinder and the exhaust gas recirculation tube.

29. The engine of claim 28 wherein the barrier is coupled to the exhaust system.

30. The engine of claim 28 wherein the hydrocarbons are limited from exposure in the second exhaust channel.

31. The engine of claim 28 wherein the first injection system is configured to perform injection during an exhaust stroke.

32. The engine of claim 31 wherein the exhaust gas recirculation tube is configured to recirculate exhaust when the first injection system injects hydrocarbons during the exhaust stroke.

33. The engine of claim 28 wherein the barrier substantially prevents the exhaust gas recirculation tube from being exposed to hydrocarbons during active regeneration.

* * * * *